US010393378B2

(12) United States Patent
Volarevic et al.

(10) Patent No.: US 10,393,378 B2
(45) Date of Patent: Aug. 27, 2019

(54) GLOW PLUG AND METHOD FOR PRODUCING A GLOW PLUG

(71) Applicant: BorgWarner Ludwigsburg GmbH, Ludwigsburg (DE)

(72) Inventors: Damir Volarevic, Tamm (DE); Tomislav Soldo, Stuttgart (DE); Volker Dezius, Affalterbach (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 194 days.

(21) Appl. No.: 15/589,624

(22) Filed: May 8, 2017

(65) Prior Publication Data

US 2017/0328566 A1 Nov. 16, 2017

(30) Foreign Application Priority Data

May 10, 2016 (DE) ..... 10 2016 108 592

(51) Int. Cl.
*F23Q 7/00* (2006.01)

(52) U.S. Cl.
CPC ..... *F23Q 7/001* (2013.01); *F23Q 2007/004* (2013.01)

(58) Field of Classification Search
CPC ..... F23Q 2007/004; F23Q 7/001
USPC ..... 219/260–270
See application file for complete search history.

(56) References Cited

U.S. PATENT DOCUMENTS 1,579,596 A * 4/1926 Cote ..... H01H 85/10 337/290
5,310,373 A * 5/1994 Treiber ..... B21C 23/22 313/136
6,723,959 B2 * 4/2004 Heinz ..... F23Q 7/001 123/145 A
2002/0195436 A1 * 12/2002 Kumada ..... F23Q 7/001 219/270
2007/0241092 A1 * 10/2007 Suzuki ..... F23Q 7/001 219/260
2008/0060835 A1 * 3/2008 Stacy ..... H01B 17/306 174/152 R
2009/0179023 A1 * 7/2009 Annavarapu ..... F23Q 7/001 219/260
2010/0095707 A1 * 4/2010 Chui ..... B29C 43/222 65/391
2010/0224613 A1 * 9/2010 Haussner ..... F23Q 7/001 219/267
2013/0180975 A1 * 7/2013 Okumura ..... F23Q 7/001 219/270

(Continued)

FOREIGN PATENT DOCUMENTS

DE 100 41 282 A1 3/2002
DE 101 60 919 C1 4/2003

(Continued)

*Primary Examiner* — William M McCalister
(74) *Attorney, Agent, or Firm* — Bose McKinney & Evans LLP

(57) ABSTRACT

A glow plug is described, having a body, a glow pin which protrudes from a first end of the body, and an inner pole which protrudes from a second end of the body and is electrically connected to the glow pin. A section of the inner pole that protrudes out of the body has an embossed structure for improving the mechanical and electrical connection to a plug connector. A method for producing a glow plug is also disclosed.

4 Claims, 1 Drawing Sheet

(56) References Cited

U.S. PATENT DOCUMENTS

| | | | | |
|---|---|---|---|---|
| 2014/0260503 | A1* | 9/2014 | Therrien | B21D 37/10 72/372 |
| 2014/0361000 | A1* | 12/2014 | Hatano | F02P 19/02 219/267 |
| 2016/0303844 | A1* | 10/2016 | Lebens | B41F 7/20 |
| 2017/0328566 | A1* | 11/2017 | Volarevic | F23Q 7/001 |

FOREIGN PATENT DOCUMENTS

| | | | |
|---|---|---|---|
| DE | 102007015491 | A1 | 10/2007 |
| EP | 2 762 783 | A1 | 8/2014 |
| GB | 960068 | | 6/1964 |
| JP | 2014/029229 | A | 2/2014 |
| WO | WO 2011/049578 | A1 | 4/2011 |
| WO | WO 2015/173017 | A1 | 11/2015 |

* cited by examiner

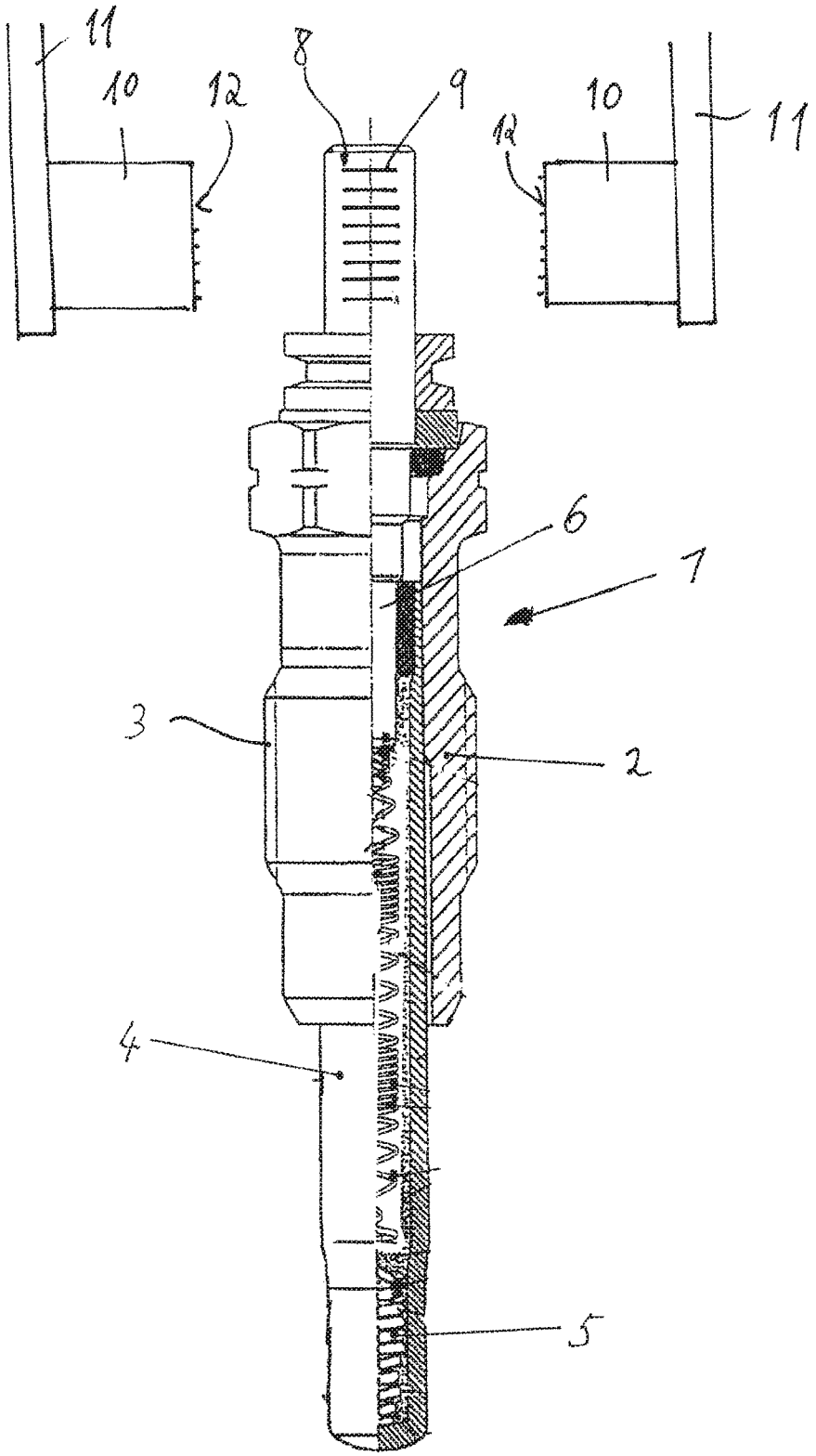
11
10
12
8
9
10
12
11
6
7
3
2
4
5

GLOW PLUG AND METHOD FOR PRODUCING A GLOW PLUG

RELATED APPLICATIONS

This application claims priority to DE 10 2016 108 592.8, filed May 10, 2016, the entire disclosure of which is hereby incorporated herein by reference in its entirety.

BACKGROUND

The present invention relates to a glow plug like the type disclosed in GB 960 068 and DE 10 041 282 A1.

The section of the inner pole that protrudes out of the body of a glow plug is intended to be connected to a plug connection or a screw connection for the purpose of electrical contacting.

The inner pole of the glow plug can be designed as a single part or as two parts with an inner pole extension. The standard two-piece design consists of a pole feed conductor on the glow-pin side and an inner pole extension on the connector side. During the production process the inner pole extension is normally welded to the end of the pole feed conductor of a pre-assembled glow pin. To provide better handling in the assembly process, the inner pole extension can consist of a plain round rod that is welded onto the pole feed conductor. If a connector plug is now directly crimped onto this rod, the possible parameters for extraction and twisting are limited. The presence of an oxide layer on the rod can also lead to increased contact resistances between the plug connector and the inner pole extension. In order to improve the mechanical and electrical connection it is known to cut a knurling into the connector-side end of the inner pole, or inner pole extension. As a result of the knurling of the outer surface, any oxide layers formed on the surface are broken up and during the crimping operation a mechanical meshing is obtained between the connector sleeve and the inner pole, or inner pole extension. The result is a significant improvement in the extraction and rotation parameters and in the electrical contact. However, cutting a knurling is a time-consuming process.

SUMMARY

This disclosure teaches a method by which a glow plug, the inner pole of which facilitates a mechanically robust and sound electrical connection to a plug connection, can be produced in a less time-consuming manner.

According to this disclosure, a structure for improving the mechanical and electrical connection to a plug connector is embossed into a section of the inner pole which protrudes from the body. The embossed structure can have, for example, grooves or elevations, in particular grooves that extend longitudinally, transversely or at an angle to the glow plug axis. Embossing allows, for example, a knurled structure or a pimpled structure to be produced cost-effectively. In addition, any oxide layer present is broken up during the embossing, therefore also enabling a good electrical contact to be produced.

To emboss the structure, two opposite facing stamps may be used, which are pressed against the inner pole. The end face of these stamps comprises elevations and/or depressions for embossing the desired structure. The end face can be suitably rounded or flat to fit the glow pin. One advantageous embodiment of this disclosure provides that the end face of at least one of the two stamps is flat. Both stamps preferably have a flat end face. A flat end face has the advantage that a structure can be engraved even with relatively light pressure. For a good electrical and mechanical connection, it is not absolutely necessary that the embossed structure is stamped all over. It is sufficient if the embossed structure is engraved in some sections of the circumference of the inner pole.

In order to engrave the structure into a larger proportion of the circumference of the inner pole using two stamps that have a flat end face, after a first embossing step the two stamps can be offset in the circumferential direction and pressed against the inner pole once again, so that a second embossing step takes place. If two embossing steps are intended, then the stamps are preferably offset in the circumferential direction by 90°. Three or more embossing steps can also be carried out, however. In that case the two stamps are preferably offset by 60° in the circumferential direction, or by a correspondingly smaller angle in the circumferential direction.

In the simplest case, parallel grooves are provided on the end face of the stamps, which have edges at an angle of 50° to 70°. Another possibility is to arrange a plurality of grooves at an angle to each other, for example to create a diamond-shaped or knurled structure.

The stamps can be fastened, for example, to the gripping surface of a gripper that performs the embossing with a correspondingly higher clamping force. The structure for improving a mechanical and electrical connection to a plug connector can be engraved on an inner pole extension, which is only welded to another inner pole section after the embossing of the structure has taken place. It is also possible, however, to use a single-part inner pole and to engrave the structure into this. The structure can be produced before or after the assembly of the glow pin in the body of the plug.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein:

FIG. 1 shows an embodiment of a glow plug according to this disclosure and an embossing tool.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

The glow plug 1 comprises a body 2, which may have a thread 3 for screwing the glow plug into an engine and a glow pin 4 which protrudes from a first end of the body 2. The glow pin 4 may be a ceramic glow pin or a glow pin comprising a metallic shell and a heating resistor, e.g., a coil 5.

The glow pin 4 is electrically connected to an inner pole 6 which protrudes from a second end of the body 2. An end section of the inner pole 6 that protrudes from the body 2 comprises an embossed structure 8 for improving the mechanical and electrical connection to a plug connector. The embossed structure may comprise grooves 9 or elevations, e.g., studs or pimples.

The structure 8 is created in the end section of the inner pole 6 by embossing. The embossing process is performed by an embossing tool, e.g., to opposite facing stamps 10 that are pressed by a gripper 11 against the end section of the inner pol 6 in order to emboss the structure 8. The stamps 10 each have a surface 12 configured for embossing grooves 9 or elevations. To this end, the surface 12 may have ridges or other elevations like studs, for example.

The surface 12 of the stamps 10 may be concave to match the generally cylindrical surface of the end section of the inner pole 6 or it may be flat. If the surface 12 is flat, the inner pole 6 and the glow plug may be rotated by, e.g., a quarter turn after a first embossing step. Then a second embossing step can emboss the structure 8 on a different part of the surface of the inner pole 6.

The embossing process can be performed after the glow plug is assembled. It is also possible to perform the embossing process on the inner pole 6 before the glow plug 2 is assembled or to perform the embossing process on a part of the inner pole 6 and to then connect this part, e.g., by welding, to a different part of the inner pole 6.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A method for producing a glow plug, comprising:

connecting a glow pin to an inner pole;

arranging the glow pin and the inner pole in a body such that the glow pin protrudes from a first end of the body and the inner pole protrudes from a second end of the body;

embossing a structure into a section of the inner pole which protrudes from the body in the finished glow plug;

wherein the structure is embossed by two opposite facing stamps that are pressed against the inner pole and at least one of the two stamps has a flat end face having elevations and/or indentations for embossing the structure;

wherein after a first embossing step, the two stamps are pressed against the inner pole again after being offset in the circumferential direction, and a second embossing step is then performed.

2. The method according to claim 1, wherein the stamps comprise a surface configured for embossing grooves or elevations.

3. The method according to claim 1, wherein the stamps are fixed to the gripping surface of a gripper.

4. The method according to claim 1, wherein the structure is embossed into a section of the inner pole which is welded onto a further inner pole section after the structure has been embossed.

* * * * *